US005537698A

United States Patent [19]

Riegler et al.

[11] Patent Number: 5,537,698

[45] Date of Patent: Jul. 23, 1996

[54] FITTING FOR COLLAPSIBLE PIECES OF FURNITURE

[75] Inventors: Ulrich Riegler, Jettingen; Wolfram Böttcher, Mutzingen, both of Germany

[73] Assignee: Häfele GmbH & Co., Nagold, Germany

[21] Appl. No.: 269,885

[22] Filed: Jul. 1, 1994

[30] Foreign Application Priority Data

Jul. 8, 1993 [DE] Germany ..... 9310160 U

[51] Int. Cl.[6] ..... A47C 17/52

[52] U.S. Cl. ..... 5/282.1; 5/133; 5/136; 5/159.1

[58] Field of Search ..... 5/9.1, 136, 159.1, 5/133, 164.1, 282.1

[56] References Cited

U.S. PATENT DOCUMENTS

| | | | |
|---|---|---|---|
| 2,541,540 | 1/1951 | Patton | 5/9.1 |
| 3,828,375 | 8/1974 | Driver | 5/136 X |
| 4,370,766 | 2/1993 | Teague, Jr. | 5/133 |
| 4,736,476 | 4/1988 | Maqueira | 5/164.1 X |
| 4,899,420 | 2/1990 | Bye et al. . | |
| 5,003,134 | 7/1991 | Burchett | 5/133 |

FOREIGN PATENT DOCUMENTS 2056426 6/1972 Germany .

*Primary Examiner*—Michael F. Trettel
*Attorney, Agent, or Firm*—Friedrich Kueffner

[57] ABSTRACT

A fitting for connecting a collapsible piece of furniture, particularly a folding bed, to a wall or the like. The fitting includes bearings for the piece of furniture, for at least one swivel leg linkage of the piece of furniture and/or for devices for damping or load reduction during swivel movements of the piece of furniture. The fitting has a fastening member to be connected to a wall and a support member which can be non-rotatably connected to the fastening member, wherein the fastening member is constructed so as to position the support member and wherein the bearings are provided on the support member.

3 Claims, 4 Drawing Sheets

FITTING FOR COLLAPSIBLE PIECES OF FURNITURE

BACKGROUND OF THE INVENTION

1. Field of the Invention

The present invention relates to a fitting for connecting a collapsible piece of furniture, particularly a folding bed, to a wall or the like. The fitting includes bearings for the piece of furniture, for at least one swivel leg linkage of the piece of furniture and/or for devices for damping or load reduction during swivel movements of the piece of furniture.

2. Description of the Related Art

Particularly when the available space is limited, pieces of furniture which are used only temporarily are constructed so as to be collapsible in order to save space. For example, folding tables are commonly in use as well as so-called Murphy beds which are hinged to the interior of wardrobe-like housings and can be swiveled upwardly after use into the housing where they are stored in a space-saving manner during the time they are not in use. Appropriate fittings are used for connecting the collapsible piece of furniture to the corresponding walls or housings.

Thus, in the case of folding beds, in addition to a swivel bearing for the bed frame, these fittings usually have a bearing for a linkage provided for swiveling the swivel legs of the folding bed when the bed frame is folded in and out between a position parallel to the bed frame and a position perpendicular to the bed frame. Moreover, particularly in the case of pieces of furniture having a relatively high weight, auxiliary devices are used for damping the movement of the piece of furniture during the folding out movement thereof and for facilitating the folding by reducing the weight. These additional devices, such as gas springs, are also connected to one side of the fittings.

The known fittings are constructed as a single piece. In order to simplify and accelerate the assembly at the location of use, the folding beds are supplied by the manufacturers with preassembled fittings which are connected to the bearing points of the gas spring and the swivel leg linkage on the side of the fitting.

In order to ensure an easy and smooth swiveling of the folding bed, and for avoiding damage to the folding bed or the housing of the bed as a result of a misalignment of the bed frame in the housing interior, it is necessary to exactly align the bed frame in the bed housing. This is effected by appropriate adjustment and subsequent securing of the fittings to the housing walls.

However, the exact adjustment poses substantial difficulties in conventional fittings. Thus, for marking the fastening points of the fittings to the housing walls, it is necessary to place and align in the bed housing the entire arrangement composed of preassembled fittings, bed frame, swivel leg linkage and gas spring. However, the folding bed arrangement is very difficult to manipulate especially because of the relatively great weight of the arrangement and because of the limited space available in the housing interior. This may result in inaccuracies in the alignment of the folding bed and, consequently, in damage to the piece of furniture during the use thereof.

SUMMARY OF THE INVENTION

Therefore, it is the primary object of the present invention to provide a fitting of the above-described type which can be positioned simply, quickly and exactly and which facilitates the exact assembly of collapsible pieces of furniture on the corresponding walls or housings.

In accordance with the present invention, the fitting has a fastening member to be connected to a wall and a support member which can be non-rotatably connected to the fastening member, wherein the fastening member is constructed so as to position the support member and wherein the bearings are provided on the support member.

Fittings according to the present invention which are composed of two pieces make it possible to make available at the location of use pieces of furniture, particularly folding beds, which have preassembled fittings and whose bearings are already connected by the manufacturer to the respective bearing devices, such as the bed frame, the swivel leg linkage and/or the gas spring. Simultaneously, for the exact positioning and securing of the folding bed in the interior of the bed housing, it is no longer necessary to manipulate the entire folding bed arrangement. Rather, in the fitting according to the present invention, it is sufficient, for example, with the use of an installation template, to adjust and fasten to the interior walls of the bed housing the fitting components which serve as fastening components and are not premounted on the folding bed. Subsequently, the entire folding bed arrangement with the premounted support pieces of the fittings can be placed against the respective fastening pieces and can be connected thereto. Because of the devices for positioning the support pieces provided on the fastening pieces, the entire folding bed arrangement is easily exactly aligned when placing the support pieces against the adjusted fastening pieces. This substantially facilitates the assembly of folding beds and of other collapsible pieces of furniture. However, the simplification of the assembly is of particular importance in the age of do-it-yourself.

In order to realize an exact alignment of the piece of furniture with structurally very simple means, an advantageous further development of the present invention provides that the support member rests with at least one side against an edge of the fastening member. The edge of the fastening member can then serve as a guide means for the support member during positioning of the folding bed arrangement.

In accordance with another advantageous feature, the fastening member includes a web and a contact surface which at least partially overlaps the support member in the mounted position, wherein the fastening member can be connected at at least two points of the web to the wall and at at least two points of the contact surface to the support member. This makes it possible to align the folding bed and to secure the folding bed to the walls of the bed housing with a minimum of fastening components. The described configuration of the fastening member makes it possible, during insertion of the folding bed arrangement into the bed housing, to insert the support members premounted on the folding bed into the gap remaining between the contact surface of the fastening member and housing wall. In this position, the folding members and, thus, the entire folding bed arrangement, are also secured in transverse direction of the housing wall.

In order to prevent a play of the mounted support member in the gap remaining between the contact surface and the wall, an advantageous feature provides that the distance by which the web projects transversely of the swivel movement of the piece of furniture relative to the contact surface and which determines the gap width between the housing wall and the contact surface, corresponds approximately to the thickness of the support member.

If the web projects relative to the contact surface on both sides, a single embodiment of the fastening members can be mounted on the left wall as well as on the right wall of the housing. The advantages resulting from the fact that the fastening members can be used on the left as well as on the right with respect to the number of fitting components which must be made available are as readily apparent as the simplification of the assembly operations during which it is now no longer necessary to pay attention as to whether which embodiment of the fastening members must be attached to the wall of the bed housing.

Especially in the case of pieces of furniture which have a relatively great weight, it is recommended to use fittings whose support member cannot only be fastened to the corresponding fastening member but also to the housing wall.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
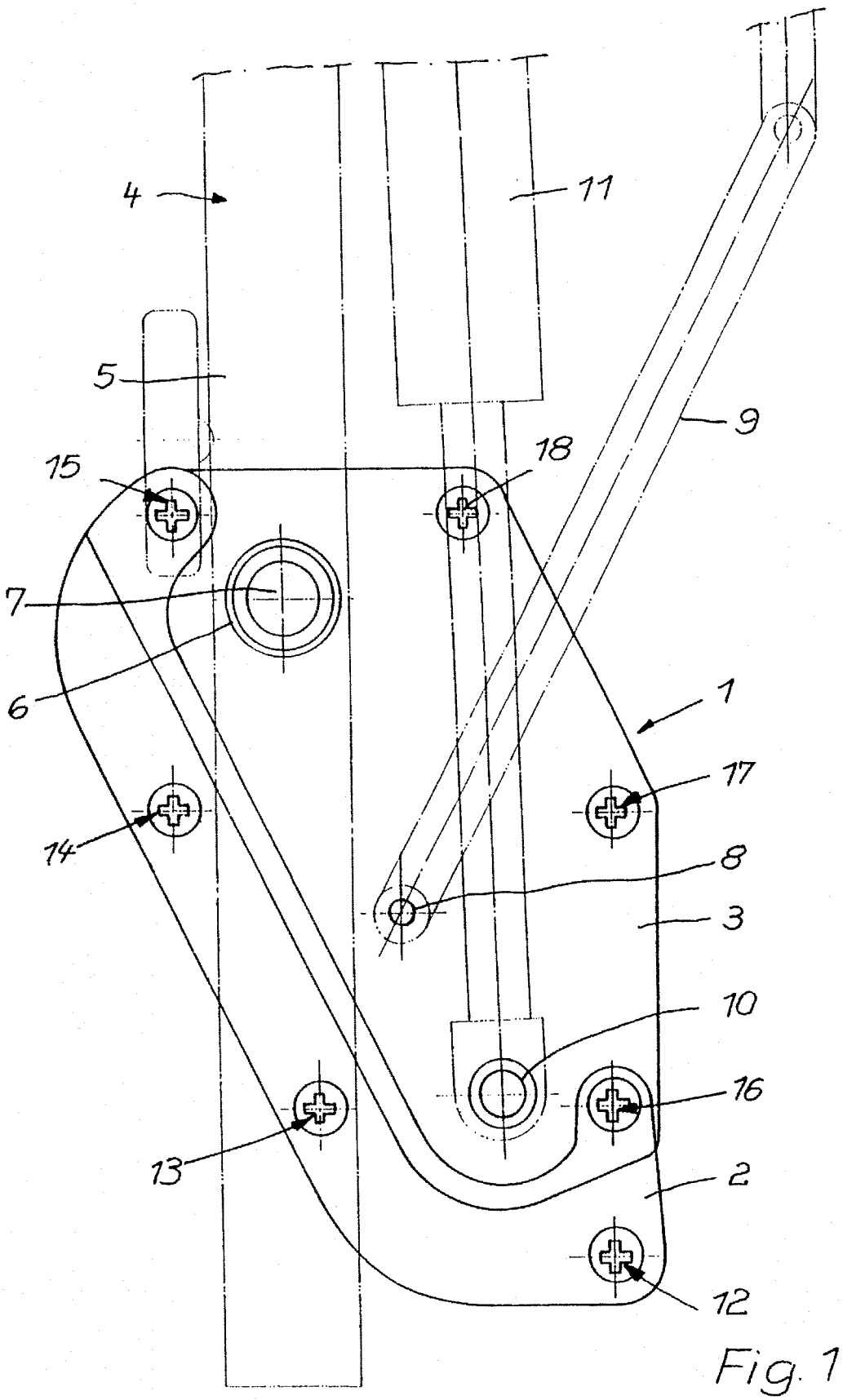
FIG. 1 is a schematic top view of a fitting for a folding bed with fastening member and support member in the assembled position.

In an embodiment of a fitting 1 illustrated in FIG. 1 of the drawing, the fitting 1 includes a fastening member 2 in the form of a fastening stirrup and a support member 3 in the form of a bearing plate. The fitting 1 serves to fasten a folding bed 4 to a wall, not shown, of a bed housing. The folding bed 4 is rotatably mounted on a bed frame 5 by means of a bearing eye 6 on a bearing shaft 7 of the bearing plate 3. The bearing plate 3 additionally has a bearing shaft 8 for a swivel leg linkage 9 and a bearing shaft 10 for a gas spring 11. At their ends facing away from the bearing plate 3 and not illustrated in FIG. 1, the swivel leg linkage 9 and the gas spring 11 are mounted on the bed frame 5. The fastening stirrup 2 is fastened by means of screw connections 12, 13, 14, 15, 16 to a side wall, not shown, of the bed housing. The screw connections 15, 16 simultaneously serve to fasten the bearing plate 3 which, moreover, is fastened to the wall by means of screw connections 17, 18.

Figure 3:
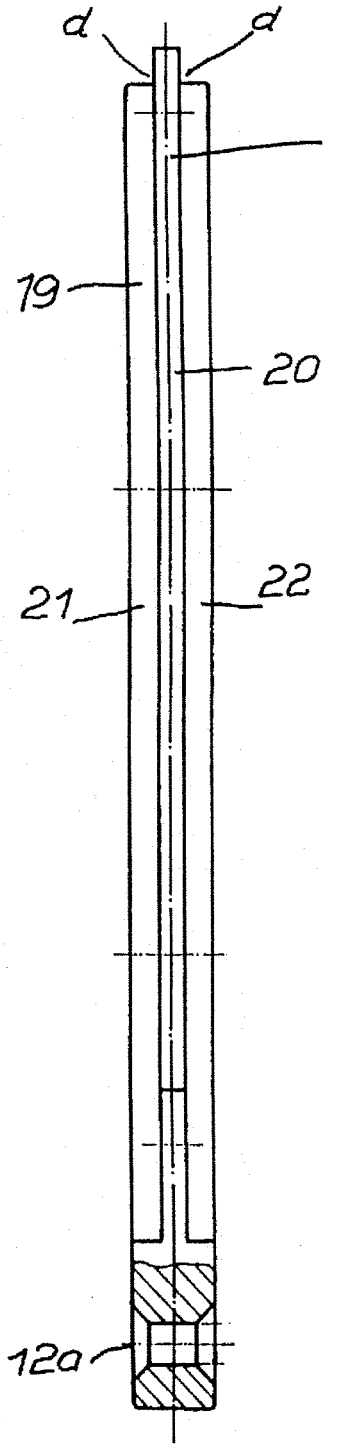
FIG. 3 is a side view of the fastening stirrup of FIG. 2.
Figure 2:
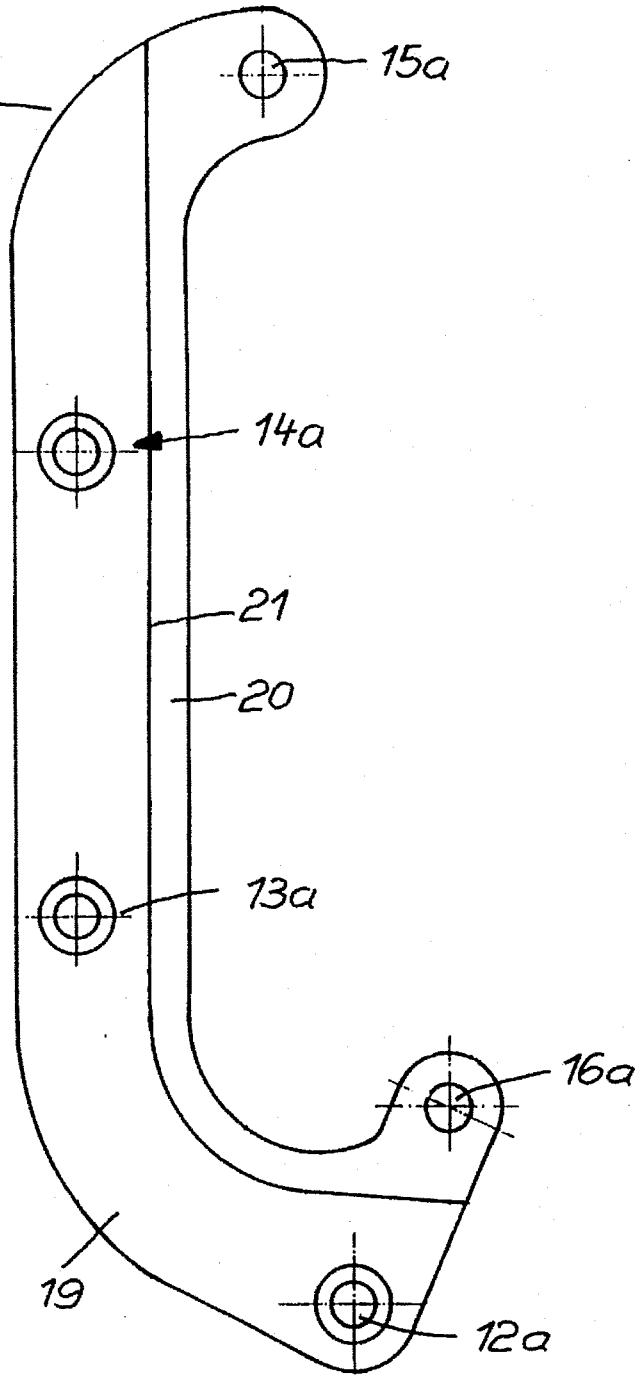
FIG. 2 is a top view of a fastening member in the form of a fastening stirrup.
Figure 4:
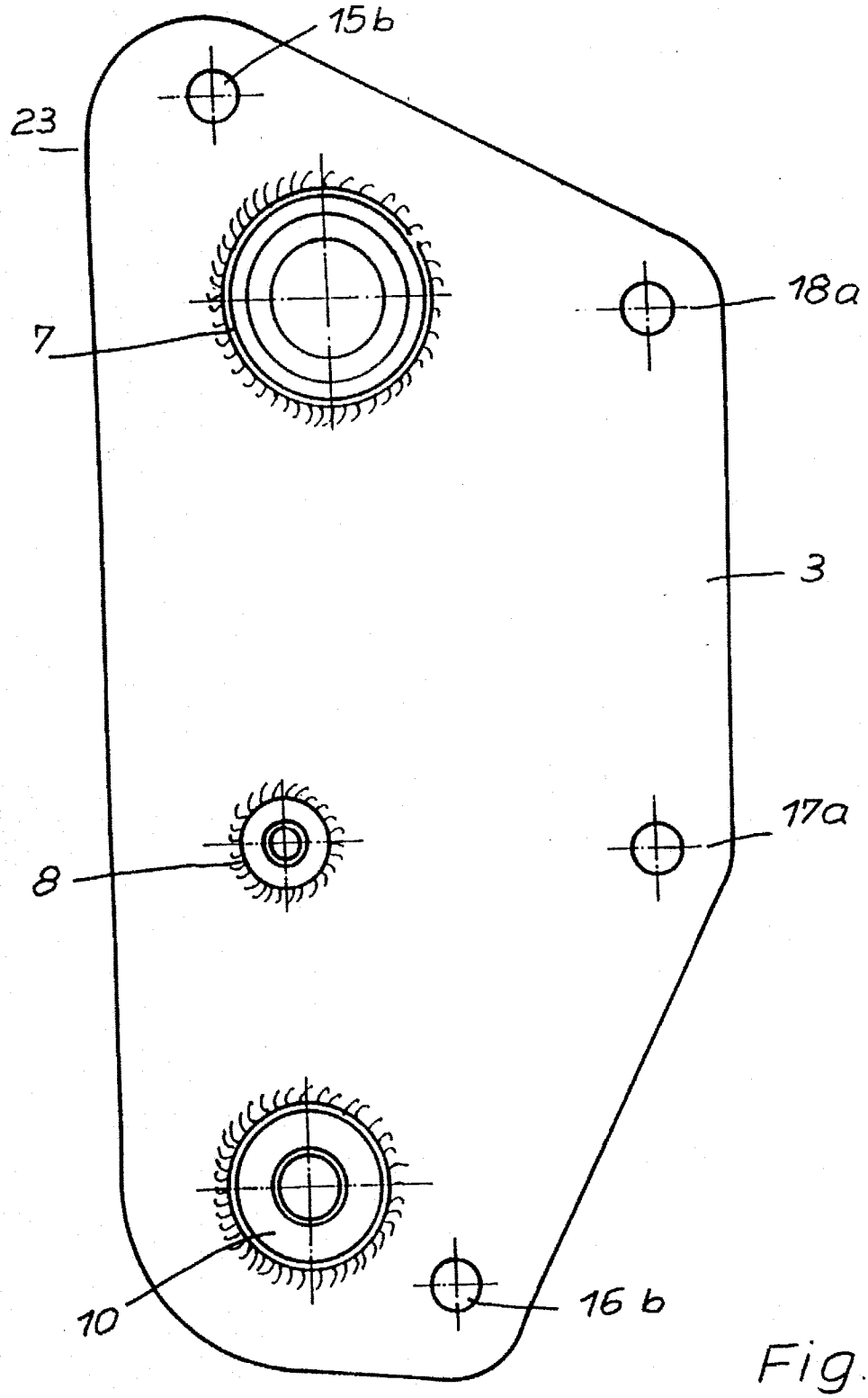
FIG. 4 is a top view of the support member in the form of a bearing plate.

As illustrated in FIGS. 2 and 3, the fastening stirrup 2 includes a web 19 with bores 12*a*, 13*a*, 14*a* and a contact surface 20 with bores 15*a*, 16*a*. The thickness of the web 19 exceeds the thickness of the contact surface 20. Consequently, the web projects beyond the contact surface 20 in transverse direction toward both sides by a distance d each. Guide surfaces 21, 22 exist at the transition between the web 19 and the contact surface 20, wherein the guide surfaces 21, 22 extend perpendicularly to the contact surface 20. The shapes of the guide surfaces 21, 22 of the fastening stirrup 2 are adapted to the outer contour of the bearing plate 3 illustrated in FIG. 4.

For mounting the folding bed 4 in a bed housing, the folding bed 4 is supplied by the manufacturer with preassembled bearing plate 3. The bed frame 5, the swivel leg linkage 9 and the gas spring 11 are connected to the bearing plate 3 at bearing shafts 7, 8, 10, respectively. For mounting the folding bed 4, initially a fastening stirrup 2 is attached to the two walls of the respective bed housing. Advantageously, this is effected by means of an assembly template which provides the positions of the screw connections 12, 13, 14, 15, 16 at the oppositely located housing walls. Each fastening stirrup 2 is initially screwed to the respective wall only at the bores 12*a*, 13*a*, 14*a*.

After the fastening stirrup has been mounted, the arrangement composed of two bearing plates 3, the bed frame 5, the swivel leg linkage 9 and the gas spring 11 is inserted into the interior of the housing. For this purpose, the bearing plates 3 are placed with a side surface 23 each against the guide surface 21 or the guide surface 22 of the fastening stirrups 2 which had been screwed to the walls. Because of their shape, the guide surfaces 21, 22 serve to guide the side surfaces 23 of the bearing plate 3. In addition, the fastening stirrups 2 overlap the bearing plates 3 with the contact surfaces 20.

Figure 5:
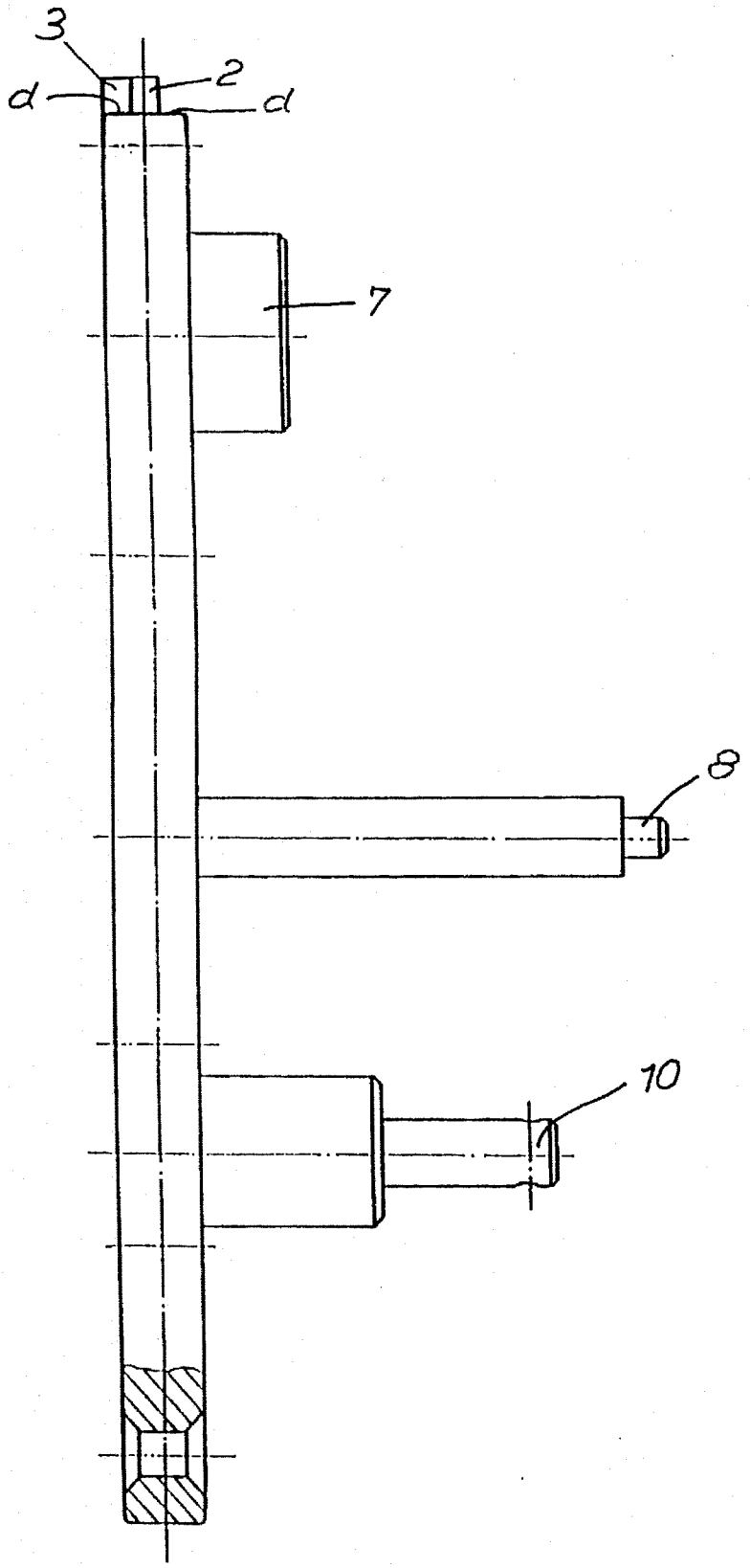
FIG. 5 is a side view of the fastening stirrup of FIG. 2 with a bearing plate of FIG. 4 being slid onto the fastening stirrup.

As illustrated in FIG. 5, the thickness of the bearing plate 3 corresponds to the projecting distance of the web and, thus, to the width of the gap which exists at the assembled fastening stirrups 2 between the wall of the bed housing and the contact surface 20. Consequently, the bearing plates 3 can be slid with their side surfaces 23 along the guide surfaces 21, 22 of the fastening stirrup 2 and are guided without play also in transverse direction relative to the sidewalls of the bed housing.

When the bores 15*a*, 16*a* of the fastening stirrup 2 are in alignment with the bores 15*b* and 16*b* of the bearing plates 3, the bearing plates 3 and, thus, the folding bed arrangement attached thereto are exactly aligned. In this position, the bearing plates 3 can be screwed by means of the screw connections 15, 16 to the fastening stirrups 2 and secured to the housing walls. If the weight of the folding bed makes it necessary, the bearing plates 3 may additionally be screwed to the walls at the bores 17*a*, 18*a*.

The invention is not limited by the embodiments described above which are presented as examples only but can be modified in various ways within the scope of protection defined by the appended patent claims.

We claim:

1. A fitting for connecting a collapsible piece of furniture, particularly a folding bed, to a structural component, the fitting comprising a support member and a fastening member adjacent to the structural component, the fastening member comprising a web and a contact surface extending parallel to the structural component and at least partially overlapping the support member, the support member being non-rotatably connected in at least two points of the contact surface to the fastening member, the fastening member having at the web thereof a guide surface for the support member for positioning the support member, the support member comprising bearing points for connecting to the support member at least one of the piece of furniture, at least one swivel leg linkage of the piece of furniture and a device for damping the weight thereof during swivel movement of the piece of furniture, the fastening member being stirrup-shaped, the fastening member being connectable at least two points of the web to the structural component, the support member having a downwardly facing surface in the direction of gravity, wherein, in a mounted position, the web engages with the guide surface under the downwardly facing surface of the support member so as to support the support member, the contact surface protruding from the web, the contact surface having spaced-apart and leg-shaped end portions, each end portion having a bore, the support member having spaced-apart bores, wherein, in the mounted position of the support member, the bores of the contact surface and of the support member are in alignment with each other for connecting the support member to the contact surface.

2. The fitting according to claim 1, wherein the web projects transversely of the swivel direction of the piece of furniture beyond the contact surface on both sides thereof.

3. The fitting according to claim 1, comprising means for connecting the support member to the structural component.

* * * * *